US007946068B2

(12) United States Patent
Arndt

(10) Patent No.: US 7,946,068 B2
(45) Date of Patent: May 24, 2011

(54) TRIGGER SYSTEM FOR A PAINTBALL MARKER

(76) Inventor: Joseph Raymond Arndt, Monument, CO (US)

( * ) Notice: Subject to any disclaimer, the term of this patent is extended or adjusted under 35 U.S.C. 154(b) by 0 days.

(21) Appl. No.: 11/701,000

(22) Filed: Feb. 1, 2007

(65) Prior Publication Data

US 2008/0053424 A1 Mar. 6, 2008

Related U.S. Application Data

(60) Provisional application No. 60/841,049, filed on Aug. 30, 2006.

(51) Int. Cl.
*F41A 19/06* (2006.01)

(52) U.S. Cl. ..... 42/69.01

(58) Field of Classification Search ..... 42/1.11, 42/69.01

See application file for complete search history.

(56) References Cited

U.S. PATENT DOCUMENTS 1,184,078 A * 5/1916 Cooke ..... 42/118
1,226,443 A * 5/1917 Baker ..... 239/280
1,377,015 A * 5/1921 McGrath ..... 42/1.11
1,740,080 A * 12/1929 Evert ..... 42/1.11
1,854,449 A * 4/1932 Collins ..... 239/654
2,102,568 A * 12/1937 Elkins ..... 42/1.11
2,344,566 A * 3/1944 Selman ..... 89/37.03
2,411,909 A * 12/1946 Temple ..... 42/39.5
2,416,769 A * 3/1947 Palmer ..... 396/426
2,775,165 A * 12/1956 Lochhead ..... 89/139
2,889,653 A * 6/1959 Clauser et al. ..... 42/1.15
3,007,700 A * 11/1961 Campbell ..... 273/445
3,296,729 A * 1/1967 Stevens, Jr. ..... 42/59
3,899,845 A * 8/1975 Wild et al. ..... 42/69.01
4,147,220 A * 4/1979 Swiderski et al. ..... 173/170
4,986,019 A * 1/1991 Dennis, Jr. ..... 42/69.01
5,074,190 A * 12/1991 Troncoso ..... 89/136
6,951,071 B1 * 10/2005 Acosta et al. ..... 42/69.01
2002/0088449 A1 * 7/2002 Perrone ..... 124/74
2003/0005918 A1 * 1/2003 Jones ..... 124/70
2003/0024520 A1 * 2/2003 Dobbins ..... 124/73
2006/0288625 A1 * 12/2006 Williams ..... 42/70.11

FOREIGN PATENT DOCUMENTS

JP 01179898 A * 7/1989

* cited by examiner

*Primary Examiner* — Troy Chambers
(74) *Attorney, Agent, or Firm* — Dale B Halling

(57) ABSTRACT

A trigger system for a paintball marker has a string attached to the trigger actuator. The string is held taut between the actuator and the trigger guard. The actuator is a lever attached to the string and in contact with a micro-switch that allows the release of compressed air to propel a paintball.

15 Claims, 2 Drawing Sheets

TRIGGER SYSTEM FOR A PAINTBALL MARKER

RELATED APPLICATIONS

The present invention claims priority on provisional patent application, Ser. No. 60/841,049, filed on Aug. 30, 2006, entitled "Trigger for Paintball Marker" and is hereby incorporated by reference.

FIELD OF THE INVENTION

The present invention relates generally to the field of paintball and more particularly to a trigger for a paintball marker.

BACKGROUND OF THE INVENTION

In paintball the faster the firing rate of the paintball marker (gun) the greater the advantage to the user. As a result, automatic firing guns are not permitted by paintball rules. In addition, having a trigger that fires both upon squeezing and releasing is not allowed. This limits most paintball markers to two finger single actuation triggers. These are cumbersome and the firing rate is limited by the user's ability to squeeze their fingers. Thus there exists a need for a trigger assembly that has single a actuation but is easier and faster than present trigger systems.

SUMMARY OF INVENTION

A trigger system for a paintball marker that overcomes these and other problems has a string attached to the trigger actuator. The string is held taut between the actuator and the trigger guard in one embodiment. The actuator is a lever attached to the string and in contact with a micro-switch that allows the release of compressed air to propel a paintball. As a result, when the user taps the string the micro-switch is actuated and a paintball is fired. This action only takes a very small finger movement and allows the user to fire paintballs faster than with a conventional two finger trigger.

DETAILED DESCRIPTION OF THE DRAWINGS

The present application relates to a trigger system for a paintball marker that has a string attached to the trigger actuator. The string is held taut between the actuator and the trigger guard in one embodiment. The actuator is a lever attached to the string and in contact with a micro-switch that allows the release of compressed air to propel a paintball. As a result, when the user taps the string the micro-switch is actuated and a paintball is fired. This action only takes a very small finger movement and allows the user to fire paintballs faster than with a conventional two finger trigger.

Figure 1:
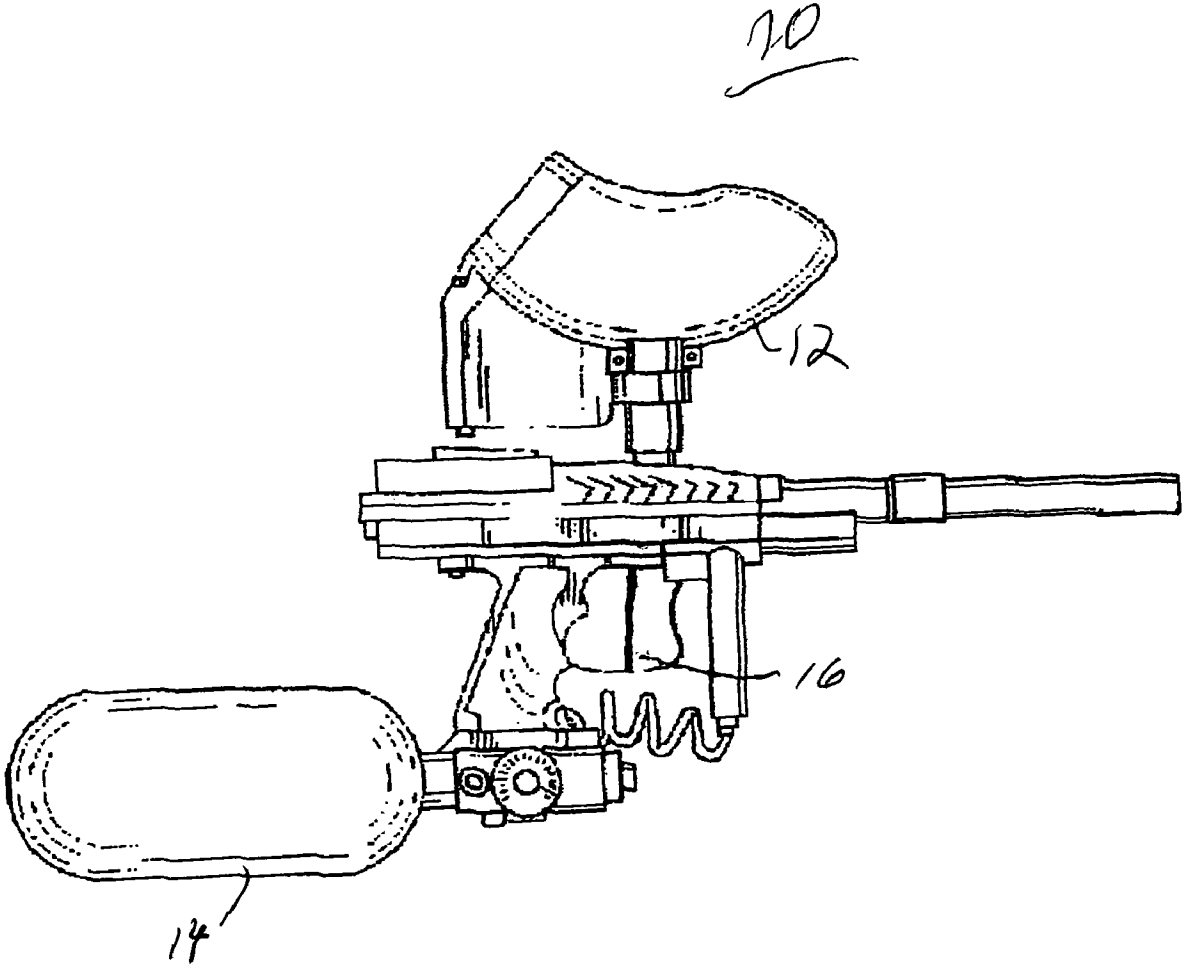
FIG. 1 is a paintball marker in accordance with one embodiment of the invention.

FIG. 1 is a paintball marker 10 in accordance with one embodiment of the invention. The paintball marker 10 had a paintball magazine 12, that holds a number paintballs for feeding a firing chamber. A compressed gas canister 14 is used to propel the paintballs. A string 16 is the trigger for the paintball marker 12 and causes a burst of compressed air to be released that propels a paintball. Note that the string can be a cord, filament or any other similar flexible item and the string may be made of a number of different materials. The string trigger actuates a switch that allows a burst of compressed gas to be released.

Figure 2:
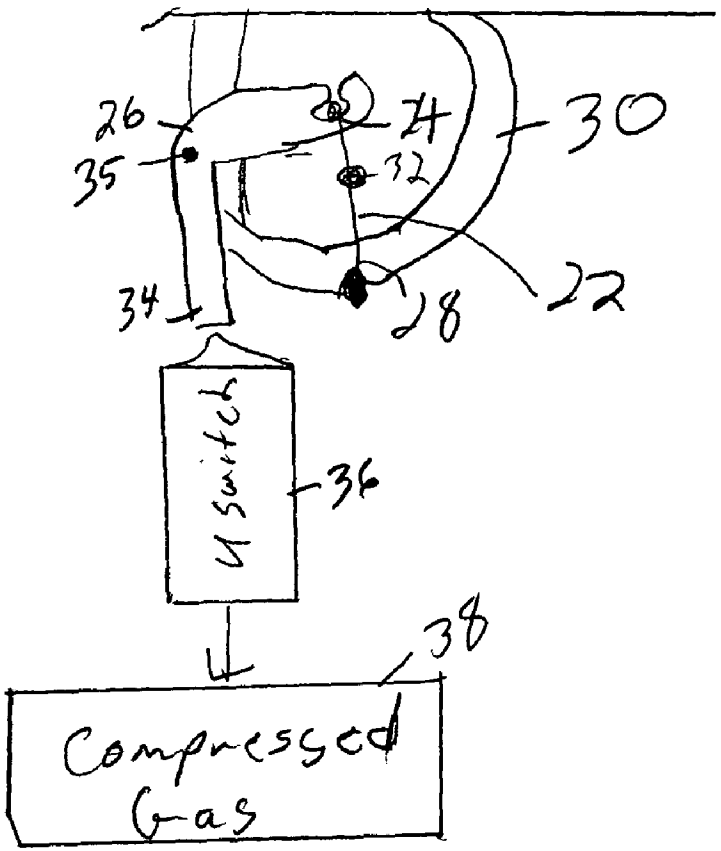
FIG. 2 is a trigger system for a paintball marker in accordance with one embodiment of the invention.

FIG. 2 is a trigger system 20 for a paintball marker in accordance with one embodiment of the invention. The trigger system 20 has a string trigger 22. The string trigger 22 is held taut. In one embodiment, one end 24 of the string 22 is attached to a lever 26 and a second end 28 of the string 22 is attached to the trigger guard 30. The string trigger 22 may be removed from the lever 26 or from the trigger guard 30 in one embodiment. This is illustrated by the notches in the lever 26 that a bead or knot at the end of the string 22 fits into. However other attachment systems may also be used. The string trigger 22 is shown with a bead 32 that has been threaded onto the string 22. One or more beads may be threaded onto the string 22 to adjust the feel of the trigger for the user. The second end 34 of the lever 26 is in contact with a micro-switch 36. The lever 22 has a pivotal attachment 35. The switch 36 controls the release of compressed gas 38 that propels a paintball. Note that the switch 36 may not be a mechanical switch, but may be an optical, electrical, magnetic, etc. switch. In that case the lever 26 is in contact by placing the second end 34 in a position to cause the switch to trip when the string 22 is plucked. Note that the lever 26 and micro-switch 36 may be considered a trigger actuator. Other trigger actuator systems may also be used and are encompassed by the present invention.

Thus there has been described a trigger system for a paintball marker that allows the user to fire paintballs faster than with a conventional two finger trigger. The trigger system has a string attached to the trigger actuator. The string is held taut between the actuator and the trigger guard in one embodiment. The actuator is a lever attached to the string and in contact with a micro-switch that allows the release of compressed air to propel a paintball. As a result, when the user taps the string the micro-switch is actuated and a paintball is fired. This action only takes a very small finger movement and allows the user to fire paintballs faster than with a conventional two finger trigger.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A trigger system for a paintball marker, comprising:

a micro-switch actuator;

a lever having a first end in contact with the micro-switch; and a string connected to a second end of the lever and to a trigger guard.

2. The trigger system of claim 1, wherein the string is detachably connected to the lever.

3. The trigger system of claim 1, wherein the string is taut between the lever and the trigger guard.

4. The trigger system of claim 3, further including a bead threaded though the string.

5. A trigger system for a paintball marker, comprising:

an actuator;

a string connected to the actuator for moving the actuator; and a bead threaded onto the string.

6. The trigger system of claim 5, wherein the actuator includes a micro-switch.

7. The trigger system of claim 6, wherein the actuator includes a lever having a first end in contact with the micro-switch.

8. The trigger system of claim 7, wherein the lever has a second end attached to the string.

9. The trigger system of claim 8, wherein the string is held taut.

10. The trigger system of claim 9, wherein the string is detachable from the lever.

11. The trigger system of claim 10, wherein the string is attached to the trigger guard.

12. A trigger system for a paintball marker, comprising:

a taut string;

an actuator connected to one end of the string; and a trigger guard attached to a second end of the string.

13. The trigger system of claim 12, wherein the string is detachable.

14. The trigger system of claim 13, wherein the actuator includes a switch.

15. The trigger system of claim 14, wherein the actuator includes a lever having a first end in contact with the switch and a second end attached to the string.

* * * * *